US012173994B2

(12) United States Patent
Spears et al.

(10) Patent No.: US 12,173,994 B2
(45) Date of Patent: Dec. 24, 2024

(54) SHAPED CHARGE SYSTEMS WITH WAVESHAPER-EMBEDDED FUZING

(71) Applicant: L3Harris Technologies, Inc., Melbourne, FL (US)

(72) Inventors: Zac Spears, New Richmond, OH (US); Scott Hill, Huntsville, AL (US); Scott Ashley, Cincinnati, OH (US); Rita Kerrigan, Gilbert, AZ (US); Justin Sweitzer, Huntsville, AL (US); David Simmons, Decatur, AL (US)

(73) Assignee: L3Harris Technologies, Inc., Melbourne, FL (US)

( * ) Notice: Subject to any disclaimer, the term of this patent is extended or adjusted under 35 U.S.C. 154(b) by 70 days.

(21) Appl. No.: 18/308,771

(22) Filed: Apr. 28, 2023

(65) Prior Publication Data

US 2024/0361107 A1 Oct. 31, 2024

(51) Int. Cl.

| | |
|---|---|
| ***F42B 1/024*** | (2006.01) |
| ***F42B 12/16*** | (2006.01) |
| ***F42C 15/40*** | (2006.01) |

(52) U.S. Cl.

CPC ..... *F42B 1/024* (2013.01); *F42B 12/16* (2013.01); *F42C 15/40* (2013.01)

(58) Field of Classification Search

CPC .. F42B 1/02; F42B 1/024; F42B 1/028; F42B 1/032; F42B 12/16; E21B 43/116; F42C 5/40

USPC ..... 102/476, 475, 481

See application file for complete search history.

(56) References Cited

U.S. PATENT DOCUMENTS

| | | | | |
|---|---|---|---|---|
| 2,809,585 | A | 10/1957 | Moses | |
| 3,100,445 | A * | 8/1963 | Poulter | C06B 23/001 102/701 |
| 4,421,030 | A * | 12/1983 | DeKoker | F42C 11/00 102/206 |
| 4,475,461 | A | 10/1984 | Durrell | |
| 4,892,039 | A | 1/1990 | Emerson et al. | |
| 4,896,609 | A | 1/1990 | Betts et al. | |
| 5,255,608 | A | 10/1993 | Min et al. | |
| 5,565,644 | A * | 10/1996 | Chawla | F42B 1/024 102/307 |
| 5,792,980 | A | 8/1998 | Weimann | |
| 5,872,324 | A | 2/1999 | Watson, Jr. et al. | |
| 6,167,811 | B1 | 1/2001 | Walters | |
| 6,295,932 | B1 | 10/2001 | Kane, III | |
| 6,393,991 | B1 * | 5/2002 | Funston | F42B 1/032 102/306 |
| 6,467,416 | B1 | 10/2002 | Daniels et al. | |
| 6,983,698 | B1 | 1/2006 | Walters et al. | |
| 7,040,234 | B1 | 5/2006 | Maurer et al. | |

(Continued)

FOREIGN PATENT DOCUMENTS

| | | | |
|---|---|---|---|
| DE | 102010018187 | A1 | 10/2011 |
| GB | 2522413 | A | 7/2015 |

(Continued)

*Primary Examiner* — John Cooper

(74) *Attorney, Agent, or Firm* — Edell, Shapiro & Finnan, LLC

(57) ABSTRACT

A shaped charge system controlled by an electronic safe and arm device located outside a system chamber comprises a billet of explosive fill material in the chamber, a waveshaper disposed in the explosive material, and a detonator and firing module disposed within the waveshaper.

15 Claims, 3 Drawing Sheets

(56) References Cited

U.S. PATENT DOCUMENTS

| | | | | |
|---|---|---|---|---|
| 7,240,617 | B1 | 7/2007 | Bonbrake et al. | |
| 7,752,972 | B1 * | 7/2010 | Baker | F42B 1/024 102/476 |
| 8,272,326 | B2 | 9/2012 | Berlin et al. | |
| 10,197,372 | B2 | 2/2019 | Grace et al. | |
| 10,519,736 | B2 | 12/2019 | Sokolove et al. | |
| 10,615,695 | B1 | 4/2020 | Pirozzi et al. | |
| 11,287,237 | B1 | 3/2022 | Pirozzi et al. | |
| 2003/0140811 | A1 | 7/2003 | Bone | |
| 2006/0266247 | A1 | 11/2006 | Gilliam et al. | |
| 2012/0055366 | A1 | 3/2012 | Berlin et al. | |
| 2012/0210898 | A1 | 8/2012 | Ritchie | |
| 2020/0158479 | A1 | 5/2020 | Boulanger et al. | |

FOREIGN PATENT DOCUMENTS

| | | | |
|---|---|---|---|
| JP | 2003185395 | A | 7/2003 |
| KR | 20210055173 | A | 5/2021 |

* cited by examiner

SHAPED CHARGE SYSTEMS WITH WAVESHAPER-EMBEDDED FUZING

TECHNICAL FIELD

The present disclosure relates generally to improvements in shaped charge systems employing electronic safe and arm devices and to methods of their use. More particularly, the disclosure pertains to minimizing space requirements for safe and arm devices in shaped charge systems and concomitantly preventing premature detonation due to shaped charge liner collapse.

BACKGROUND

Shaped charges are employed in warheads, oil well perforation systems and other explosive mechanism systems, and involve shaping of detonation waves in contained explosive material to enhance explosive performance. A waveshaper, typically an inert structure, is positioned rearwardly of a billet of explosive material and configured to cause the forwardly directed detonation wave to travel around the waveshaper through the explosive material and then converge to explosively increase pressure on the billet liner. Examples of such shaped charge explosive systems are disclosed in the following patent documents, the entire disclosures in which are incorporated herein by reference: U.S. Pat. No. 2,809,585 (Moses); U.S. Pat. No. 5,565,644 (Chawla); U.S. Pat. No. 6,193,991 (Funston et al); U.S. Pat. No. 6,467,416 (Daniels et al); U.S. Pat. No. 7,040,234 (Maurer et al); U.S. Pat. No. 7,752,972 (Baker et al); U.S. Pat. No. 7,975,502 (Bell et al); US2003/0140811 (Bone), US20060266247 (Gilliam et al); US20130061771 (Betancourt et al) and DE102010018187 (Werner et al).

It is also known to provide electronic safe and arm devices (ESAD) for shaped charge systems to prevent unintended detonation of their explosive fill material; see, as examples, U.S. Pat. No. 6,295,932 (Kane), U.S. Pat. No. 7,240,617 (Bonbrake et al), and U.S. Pat. No. 10,615,695 (Pirozzi et al), the entire disclosures in which are also incorporated herein by reference, as well as the aforementioned Maurer et al, Bone, and Gilliam et al patent documents.

One example of a prior art shaped charge warhead is illustrated schematically FIG. 1 of the accompanying drawings. Specifically, a shaped charge warhead 10 has a cylindrical housing or casing 12 enclosing a cavity or chamber with an open forward end 11, a closed rearward end 13 and a longitudinal axis X. A shaped charge liner 14 of generally conical shape and formed from a ductile metal or metal alloy, tapers rearwardly from and closes the open forward end 11 of the casing. A billet of secondary explosive 16 fills the chamber rearwardly of liner 14. A waveshaper 18 of inert material is embedded in the explosive billet material and has a predetermined exterior contour configured to shape the system detonation wave for the intended shaped charge characteristics. A primary or booster explosive 22, detonatable such as by application of an electric current through wires 21 connected to a detonator 20, contacts secondary explosive 16 adjacent the closed rear end wall 13 of the housing at a point on axis X opposite the apex 24 of liner 14. Detonator 20 is positioned to fire forwardly into the chamber, when triggered, to create forwardly directed detonation waves (shown in dashed lines) that are directed around waveshaper 18 through the explosive material to converge on liner 14. Depending on the liner material and configuration and on the direction of the detonation wave, the liner is blasted by explosive material 16 out through the open end 11 of the casing as a metallic jet capable of penetrating the intended target.

Typically, if an ESAD is added to the warhead, its protective circuitry and firing components would be housed with the detonator adjacent the outside surface of the rear end wall 13, thus adding a not insignificant amount of additional space for an overall system in which space is at a premium. For example, an ESAD includes circuitry (typically on a PC board) to isolate a high voltage power source from a detonator to inhibit inadvertent firing of the system. See, for example, see: U.S. Pat. No. 4,421,030 (DeKolker), U.S. Pat. No. 10,197,372 (Grace et al), U.S. Pat. No. 10,615,695 (Pirozzi et al), the entire disclosures in which are incorporated herein by reference. It would be desirable to provide the warhead or other shaped charge explosive system with an ESAD or other safe and arm feature without substantially increasing the occupied volume or space of the overall system. The systems and methods disclosed herein address this goal.

Another consideration in shaped charge systems is the potential for premature detonation. For example, to initiate detonation of the explosive billet, an impact switch or sensor may be positioned at the forward end of the casing such that, upon impact of the forward end with a target, the impact sensor sends an electrical signal to the ESAD and detonator to thereby detonate the billet of explosive fill material. Or, as described above, rather than detonating the fill material directly, detonation may be effected by booster pellets of a primary explosive material that, when electrically stimulated, create a small explosion that causes the billet material to explode. Alternatively, initiation may be effected by an accelerometer which, in cooperation with a microprocessor, determines the proper time for detonation based on warhead velocity dynamics. See, for example, the discussion in U.S. Pat. No. 5,225,608 (Min et al), the entire disclosure in which is incorporated herein by reference. In any case, upon a detonate signal being sent to the ESAD, the explosive fill material is detonated, causing the shaped charge liner to be forcefully compressed and propelled forwardly as a shaped charge jet. In certain scenarios, the warhead could potentially impact a structural target with enough force to cause the shaped charge liner to collapse before detonation occurs. This collapse may cause the explosive material, waveshaper, and booster to lurch forward and pull away from the detonator prior to the ESAD, thereby allowing the detonator high voltage switch to close and the detonator to fire prematurely. The systems and methods disclosed herein also address this problem.

SUMMARY

This Summary is provided to introduce a selection of concepts in a simplified form, the concepts being more specifically described below in the Detailed Description. This Summary is not intended to identify key features or essential features of the claimed subject matter, nor is it intended as an aid in determining the scope of the claimed subject matter.

The systems and methods disclosed herein focus on providing solutions to the above-described problems by separating the detonator and high voltage switching components from the other ESAD components and, more particularly, embedding those separated components within the waveshaper structure while maintaining the other ESAD components outside the chamber containing the explosive material. The detonator and fuzing (or firing) circuitry are thus contained entirely within the housing of inert material occupied by the waveshaper within the explosive billet and adds no additional space to the overall system. Relocating the high voltage firing components to within the waveshaper does not change the exterior configuration of the waveshaper and therefore does not affect the primary function of the waveshaper, namely, directing and shaping the detonation wave for the intended shaped charge operation.

Another advantage of separating the detonator and high voltage switching (i.e., fuzing) components from the safe and arm components and housing them within the waveshaper is that the contained firing module components move with the waveshaper and the explosive billet during the first few milliseconds of target impact, thereby avoiding their separation and premature detonation.

In one aspect, a shaped charge system comprises a billet of explosive fill material, a waveshaper disposed in the explosive material, and a detonator and firing module disposed within the waveshaper.

In another aspect a shaped charge system comprises a casing defining an interior chamber and having forward and rearward ends, a shaped charge liner disposed in the chamber, a billet of explosive fill material disposed in the chamber rearwardly of the liner, a waveshaper disposed in the explosive material between the rearward end of the chamber and the liner and a detonator and firing module disposed in said waveshaper.

In still another aspect, a method for initiating detonation waves in a shaped charge system comprises initiating an electrical detonation signal from an electronic safe and arm device located outside a chamber containing a billet of explosive material, and creating detonation waves in the explosive material from within a waveshaper embedded in the explosive material.

BRIEF DESCRIPTION OF THE DRAWINGS

By way of example, specific illustrative systems of the present disclosure will now be described with reference to the accompanying drawings in which like reference numerals in the various figures represent similar of like components.

DETAILED DESCRIPTION

Figure 1:
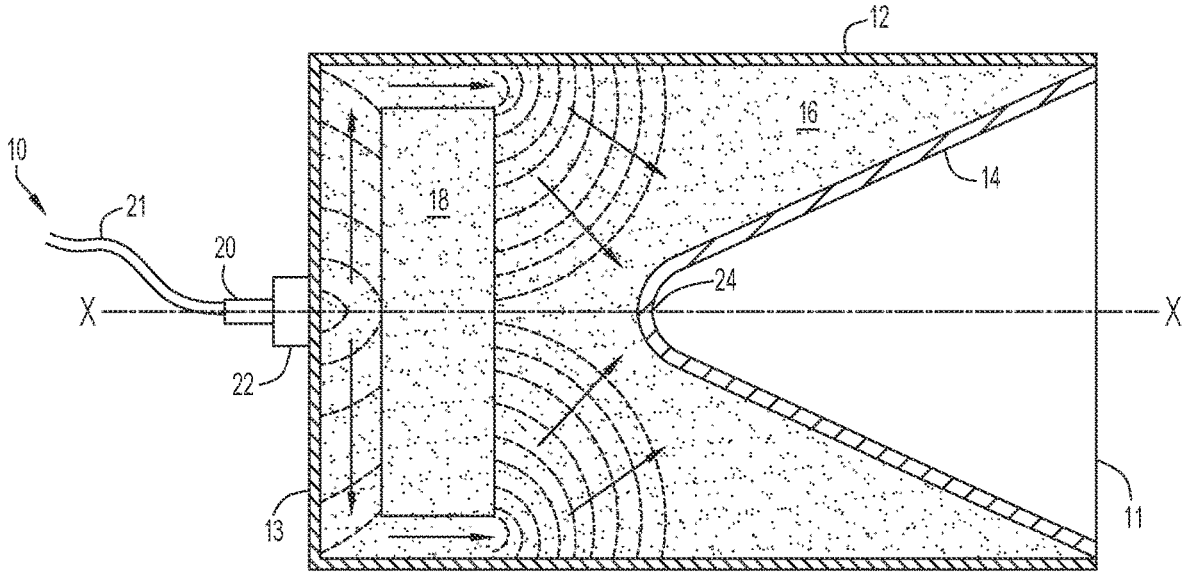
FIG.1 (PRIOR ART)
FIG. 1 is a schematic cross-sectional view of a prior art shaped charge warhead.

The present systems and methods are described more fully hereinafter with reference to the accompanying drawings. It will be readily understood that the components of the systems and methods as generally described herein and illustrated in the appended drawings may be arranged and designed in a wide variety of different configurations. Thus, the following more detailed description of systems and methods, as represented in the drawings, is not intended to limit the scope of the present disclosure but is merely representative of various systems and methods. While various aspects are presented in the drawings, the drawings are not necessarily drawn to scale unless specifically indicated.

The techniques and approaches disclosed herein may be implemented in other specific forms without departing from its spirit or essential characteristics; that is, the described implementations are to be considered in all respects only as illustrative and not restrictive. The scope of inventions disclosed herein is therefore indicated by the appended claims rather than by this detailed description. All changes that come within the meaning and range of equivalency of the claims are to be embraced within their scope.

Reference throughout this specification to features, advantages, or similar language does not imply that all of the features and advantages that may be realized with the disclosed apparatus, system and method should be or are in any single implementation. Rather, language referring to the features and advantages is understood to mean that a specific feature, advantage, or characteristic described in connection with an implementation is included in at least one implementation. Thus, discussions of the features and advantages, and similar language, throughout this specification may, but do not necessarily, refer to the same implementation.

Furthermore, the described features, advantages, and characteristics of the disclosed principles may be combined in any suitable manner in one or more implementations. One skilled in the relevant art will recognize, in light of the description herein, that the implementations can be practiced without one or more of the specific features or advantages of a particular implementation. In other instances, additional features and advantages may be recognized in certain implementations that may not be present in all implementations.

Reference throughout this specification to "one implementation," "an implementation," or similar language means that a particular feature, structure, or characteristic described in connection with the indicated implementation is included in at least one implementation. Thus, the phrases "in one implementation," "in an implementation," and similar language throughout this specification may, but do not necessarily, all refer to the same implementation.

The relative terms "forward", "rear", "length", "width", "thickness", and the like as used herein are for ease of reference in the description to merely describe points of reference and are not intended to limit any particular orientation or configuration of the described subject matter.

Figure 2:
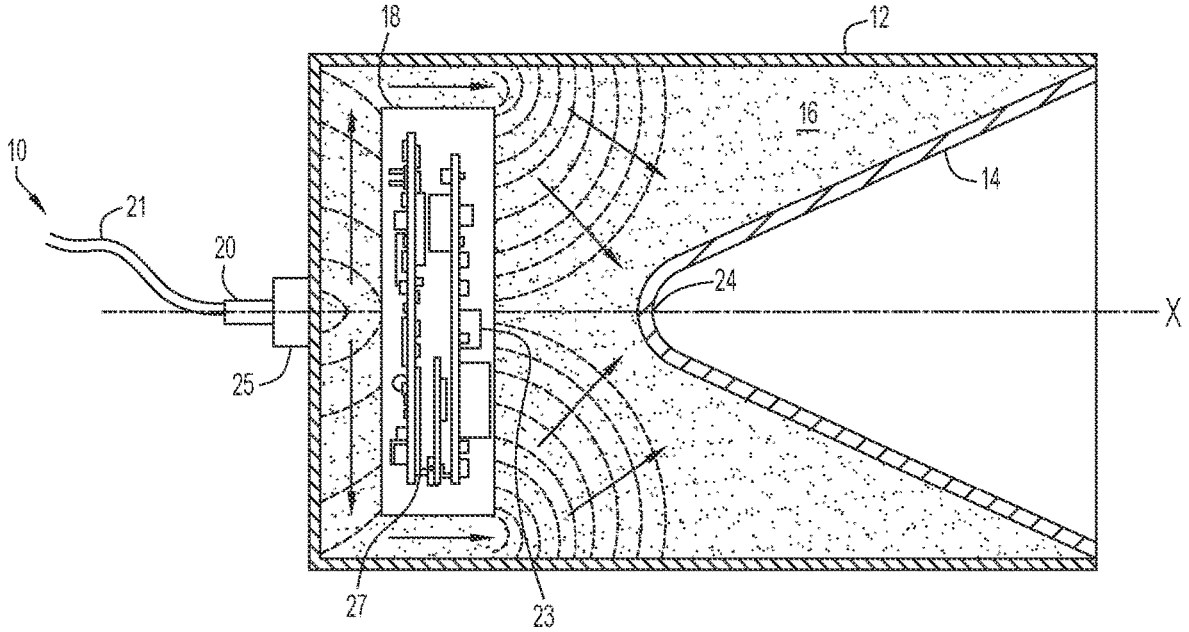
FIG. 2 is a schematic cross-sectional view of a shaped charge warhead illustrating the principles of the present disclosure.

Referring to the schematic illustration in FIG. 2, it will be seen that the shaped charge warhead 10 of FIG. 1 has been modified by adding safe and arm (ESAD) circuitry 25 outside the cavity adjacent the rear end wall of casing 12, and by placing the firing module 27 and detonator 23 inside the waveshaper 18. For this purpose, the waveshaper may be a hollow housing having a configuration appropriate for its wave shaping function or it may be filled with inert material, such as epoxy, in which the fuzing components may be embedded. Although detonator 23 is shown in FIG. 2 as being located at the forward-facing side of firing module 27, in some cases, as illustrated and described below in connection with systems in FIGS. 3, 4 and 5, the detonator may be positioned at the rearward-facing side of the waveshaper.

In operation, the safe and arm circuitry 25 detects conditions indicative of warhead launch and safe separation. Once the warhead is safely away from the launch platform the system is armed and high voltage is generated to await a trigger event. Upon receipt of a trigger signal either through electrical wiring or on-board sensors, detonator 23 is activated to initiate the detonation wave into the explosive billet 16 behind the waveshaper 18. The predetermined outer configuration of the waveshaper is not changed by the internally located firing components and detonator, and therefore performs its intended detonation waveshaping function in a manner similar to that described above in connection with FIG. 1.

Figure 3:
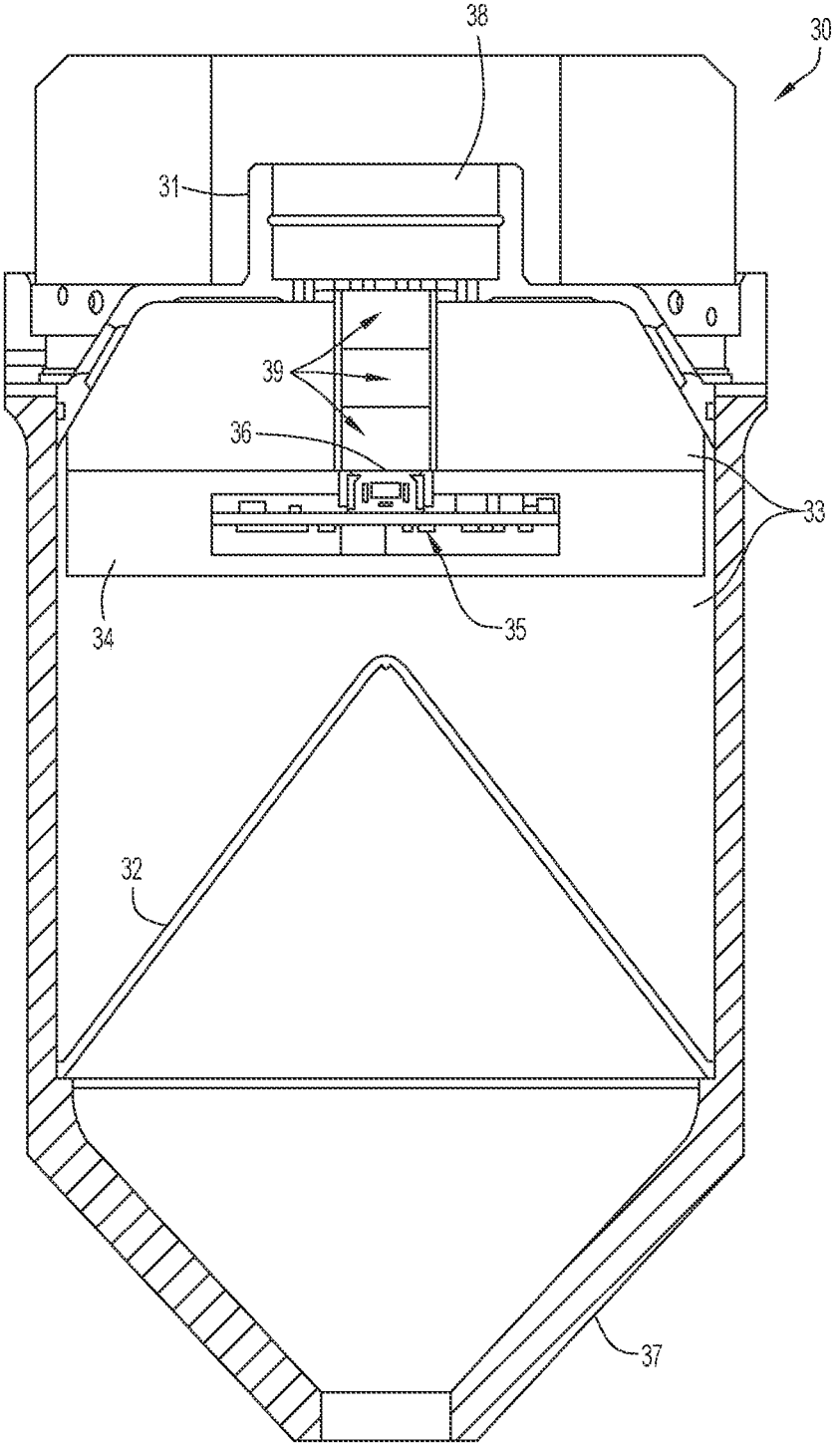
FIG. 3 is a diagrammatic cross-sectional view of a shaped charge warhead configured according to principles disclosed herein.

Referring to FIG. 3, a shaped charge warhead 30 embodying the principles described herein comprises a hardened steel casing defining an interior cylindrical chamber, and a forward-tapering, conically configured forward end 37 bearing a protective cover for armored wall penetration and fragmentation. A conical shaped charge liner 32 tapers rearwardly and extends from forward end 37 into the interior chamber. Liner 32 is typically formed from a ductile metal or metal alloy such as copper, it being understood that other metals may be used including nickel, zinc, aluminum, tantalum, tungsten, depleted uranium, antimony, magnesium and their alloys, and is selectively configured to enhance penetration of the intended target of the warhead, for example a tank or other heavy armor structure. A billet of explosive fill material 33 substantially fills the interior chamber rearwardly of shaped charge liner 32. A waveshaper 34 of inert material is embedded within the billet between liner 32 and the rearward end of the chamber. As shown, the waveshaper contains a firing module 35 with its circuitry mounted on a preferably flexible printed circuit board, or the like, which includes high voltage circuitry and detonator 36. In the implementation shown in FIG. 3, the detonator is mounted on the rearward facing surface of printed circuit board so that the detonation waves it creates are initially directed rearwardly toward the rearward end wall of the chamber which redirects the waves back toward and around the waveshaper.

An aft closure region 31, located just outside the chamber at the rearward end of the system, contains an electronic safe and arm module (ESAD) 38 from which a booster explosive, in the form of explosive booster pellets 39, extend through an access opening in the rearward end wall of the chamber into the chamber to the waveshaper 34. The booster pellets are surrounded by electrical connections extending between the ESAD module 38 and firing module 35 for activating the firing module and detonator 36 when the circuitry in the ESAD module is triggered.

In operation, under the appropriate conditions as described above, the circuitry in safe and arm module 38 triggers the firing module 35 to cause high voltage in the firing module to activate the booster pellets 39. The booster pellets initiate a detonation wave which travels into the explosive billet 33 adjacent the wave shaper 34 and then propagates around the wave shaper.

As will be appreciated, an aspect of present disclosure resides in the fact that the waveshaper 34 of inert material is configured to contain the described high voltage switching circuit of firing module 35 and detonator 36, thereby conserving system space. In addition, these contained components can remain in close proximity to the explosive fill material 33 in the chamber throughout a high shock event. The ESAD components are disposed outside the chamber and supply requisite signals to the high voltage switching circuit via wiring or copper traces surrounding the booster pellet structure.

Figure 4:
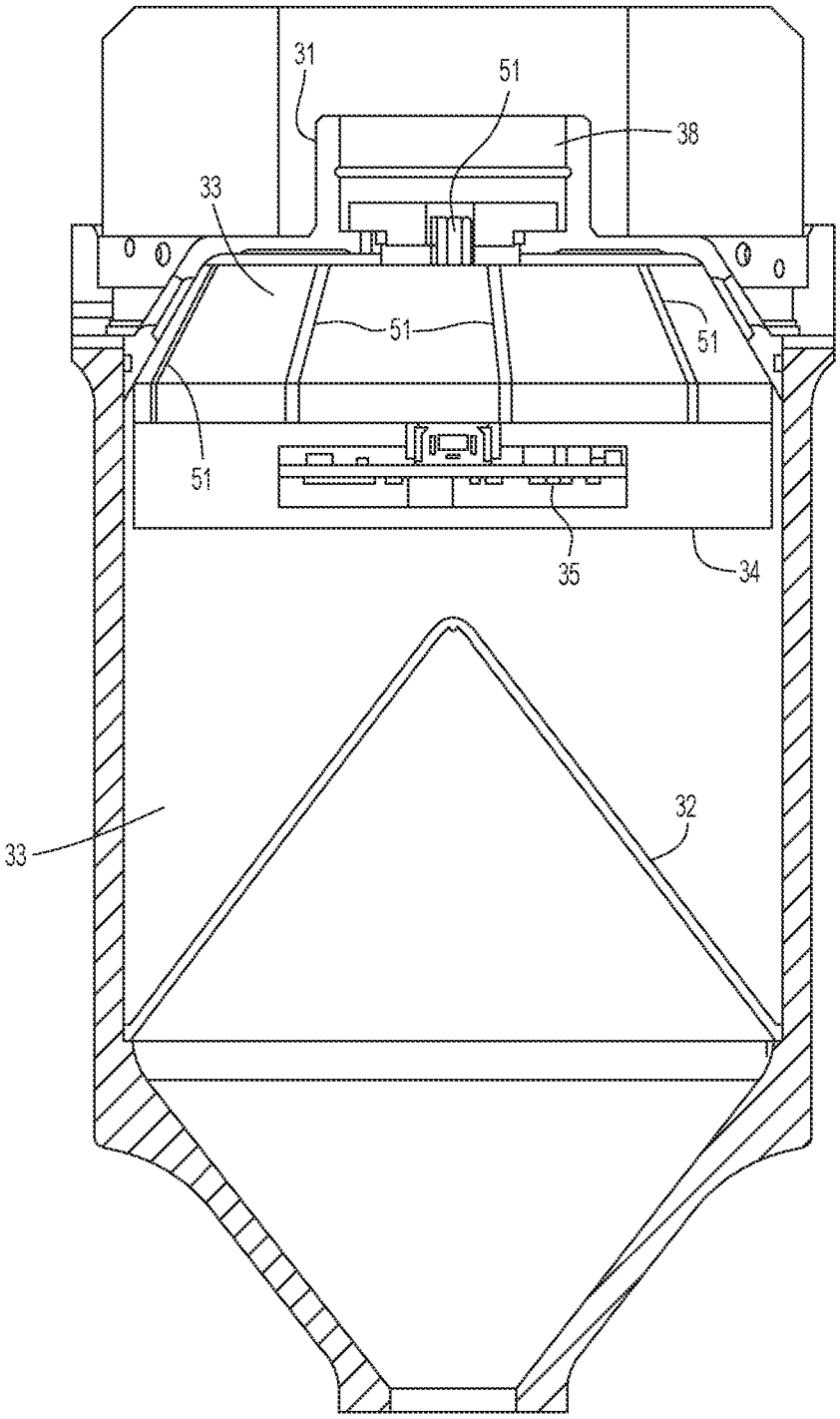
FIG. 4 is a diagrammatic cross-sectional view of another shaped charge warhead configured according to principles disclosed herein.

A modified version of the warhead is illustrated in FIG. 4 wherein the shaped charge warhead similarly comprises a hardened steel casing defining an interior cylindrical chamber, a conical shaped charge liner 32, a billet of explosive fill material 33 substantially filling the interior chamber rearwardly of shaped charge liner, and a waveshaper 34 of inert material embedded within the billet between liner 32 the rearward end of the chamber. As described above, the waveshaper contains a firing module 35 with its circuitry mounted on a preferably flexible printed circuit board, or the like, on which high voltage circuitry and detonator 36 reside. In the modified version the electrical signals from the ESAD 38 are routed around the detonator via multiple spider-like copper traces 51 to the firing module 35. More specifically, copper traces 51 extend forwardly from ESAD 38 and then radially outward in angularly spaced relation before bending forwardly to the rearward surface of waveshaper 34 where they are in contact with electrical conductors 52 that are connected to the firing module circuitry 35 disposed within the waveshaper.

An aspect of this disclosure is the separation of the safe and arm components from the firing module components, which are normally housed together at the rearward end of the warhead or other shaped charge system, such that the firing module components are placed inside the waveshaper. The benefit of this is two-fold, namely: (1) valuable space is saved by not requiring separate space for the firing module; and (2) the firing module components move with the explosive billet during the first few milliseconds after target impact thus maintaining intimate contact between the detonation components and high explosive fill material and assuring reliable detonation of the main explosive charge.

In conclusion, provided for herein are techniques that solve the problem of minimizing the space required for components in a shaped charge system employing an electronic safe and arm device while concomitantly eliminating separation of detonation components from the explosive fill material. This is achieved by separating the firing module components from the ESAD components and, more particularly, embedding the detonator and firing module in the waveshaper, which is embedded in the explosive material, while maintaining the position of the ESAD components outside the system chamber containing that material.

The above description is intended by way of example only. Although the techniques are illustrated and described herein as embodied in one or more specific examples, it is nevertheless not intended to be limited to the details shown, since various modifications and structural changes may be made within the scope and range of equivalents of the claims.

What is claimed is:

1. A shaped charge system comprising:

a casing defining an interior chamber and having a forward end and a rearward end;

a shaped charge liner disposed in the chamber;

a billet of explosive fill material disposed in the chamber rearwardly of the liner;

a waveshaper having a predetermined external contour based on desired shaped charge functional characteristics and disposed in the explosive material between the rearward end of the chamber and the liner; and a detonator and firing module disposed entirely in said waveshaper.

2. The shaped charge system of claim 1, further comprising:

an electronic safe and arm device located proximate said rearward end outside said chamber outside said chamber; and electrical conductors configured to conduct electrical signals between said safe and arm device and said firing module.

3. The shaped charge system of claim 2, further comprising;

a booster disposed between said safe and arm device and said waveshaper within said explosive material and detonatable by an electric signal from said safe and arm device to create a small explosion that causes the billet explosive material to explode.

4. The shaped charge system of claim 3, wherein said electrical conductors surround said booster to electrically connect said safe and arm device to said firing module.

5. The shaped charge system of claim 4 wherein said firing module comprises components disposed on a flexible printed circuit board located within the waveshaper.

6. The shaped charge system of claim 2 wherein said electrical conductors are electrically conductive traces that extend forwardly from said safe and arm device and then radially outward in angularly spaced relation before bending forwardly to the waveshaper to connect with the firing module.

7. The shaped charge system of claim 6 wherein said electrically conductive traces are arranged in an array in which successive traces are equiangularly spaced from one another.

8. The shaped charge system of claim 6 wherein the firing module comprises components disposed on a flexible printed circuit board having forward and rearward facing surfaces, and wherein said detonator is disposed on said rearward facing surface and configured to direct detonation waves initially in a rearward direction.

9. The shaped charge system of claim 2 wherein the firing module comprises components disposed on a flexible printed circuit board having forward and rearward facing surfaces, and wherein said detonator is disposed on said rearward facing surface and configured to direct detonation waves initially in a rearward direction.

10. A shaped charge system comprising:

a billet of explosive fill material;

a waveshaper disposed in the explosive material; and a detonator and firing module disposed entirely within said waveshaper.

11. The shaped charge system of claim 10 further comprising:

an electronic safe and arm device located separate and apart from said explosive material; and electrical conductors configured to conduct electrical signals between said safe and arm device and said firing module.

12. The shaped charge system of claim 11 wherein the firing module comprises components disposed on a flexible printed circuit board having forward and rearward facing surfaces, and wherein said detonator is disposed on said rearward facing surface and configured to direct detonation waves initially in a rearward direction.

13. A method for initiating detonation waves in a shaped charge system comprising:

in response to a trigger signal, initiating an electrical detonation signal from an electronic safe and arm device located outside a chamber containing a billet of explosive material; and in response to said electrical detonation signal, creating detonation waves in said billet of explosive material from a location entirely within a waveshaper embedded in the explosive material.

14. The method of claim 13 wherein the detonation waves are initially directed rearwardly of the waveshaper and are deflected by a rearward chamber wall forwardly and around the waveshaper.

15. The method of claim 13 wherein said electronic safe and arm device is located adjacent a rearward end wall of said chamber and wherein said detonation signal is conducted through an access opening in said rearward end wall.

* * * * *